US008754586B2

(12) United States Patent
Huang et al.

(10) Patent No.: US 8,754,586 B2
(45) Date of Patent: Jun. 17, 2014

(54) LED ILLUMINATION SYSTEM

(75) Inventors: Kuo-hsin Huang, Hsinchu (TW); Chin-Pei Lin, Hsinchu (TW); Sheng-Hua Yang, Hsinchu (TW); Fang-Hsien Kuo, Hsinchu (TW)

(73) Assignee: Excellence Opto, Inc., Hsinchu (TW)

( * ) Notice: Subject to any disclaimer, the term of this patent is extended or adjusted under 35 U.S.C. 154(b) by 320 days.

(21) Appl. No.: 13/230,736

(22) Filed: Sep. 12, 2011

(65) Prior Publication Data

US 2013/0063044 A1 Mar. 14, 2013

(51) Int. Cl.
*H05B 37/02* (2006.01)

(52) U.S. Cl.
USPC ..... 315/291; 315/307

(58) Field of Classification Search
USPC ..... 315/185 R, 200 R, 209 R, 276, 291, 307, 315/308, 312
See application file for complete search history.

(56) References Cited

U.S. PATENT DOCUMENTS

2011/0193467 A1* 8/2011 Grajcar ..... 313/113
2011/0291585 A1* 12/2011 Foo ..... 315/291

* cited by examiner

*Primary Examiner* — Jimmy Vu
(74) *Attorney, Agent, or Firm* — Muncy, Geissler, Olds & Lowe, P.C.

(57) ABSTRACT

An LED illumination system includes a DC power supply, at least two LED illumination lamp sets and at least two power circuits corresponding to the LED illumination lamp sets. The DC power supply provides sufficient electric power for the LED illumination lamp sets and is connected to the LED illumination lamp sets via the power circuits. The invention supplies electric power required by the LED illumination lamp sets via a single DC power supply without an extra DC power supply, hence the cost is lower. Moreover, the DC power supply is located remote from the LED illumination lamp sets, hence high temperature generated by the DC power supply does not affect lighting and lifespan of the LED illumination lamp sets. The hazard of electric shock by inadvertently touching the AC power source while replacing lamps in the LED illumination lamp sets can also be avoided to improve safety.

3 Claims, 4 Drawing Sheets

LED ILLUMINATION SYSTEM

FIELD OF THE INVENTION

The present invention relates to a light emitting diode (LED) and particularly to an LED illumination system.

BACKGROUND OF THE INVENTION

LED provides characteristics such as saving electric power, higher lighting efficiency and longer lifespan, thus has become a new generation of illumination element. It employs Epitaxy as a photoelectric element to generate light via electro luminescence transformation. Because the LED has many advantages, such as environment friendly, lower power consumption, higher efficiency and longer lifespan, it gradually replaces the traditional illumination equipments.

At present the LED has been widely adopted on various types of illumination apparatus. However, for indoor illumination the luminosity of a single LED still cannot match the conventional fluorescent lamp or halogen lamp. In order to provide sufficient indoor illumination, multiple LEDs have to be clustered together. At present, the LED light bulbs on the market mostly have one power converter to mate an LED. Such a structure is more expensive and consumes more electric power, and also has a shorter lifespan.

Please refer to FIG. 1 for a conventional LED illumination lamp set 1. It includes a plurality of LEDs 2 and a DC power supply 3 which receives commercial power and converts the commercial power into DC power to supply the LEDs 2. For multiple LED illumination lamp sets 1, multiple DC power supplies 3 also must be provided in a one-on-one fashion to meet use requirement.

However, the DC power supply 3 and the LEDs 2 are positioned close to each other, and heat generated by the DC power supply 3 would cause high temperature to affect lighting efficiency of the LEDs 2. Moreover, the DC power supply 3 is located in the LED illumination lamp set 1, and air circulation is undesirable that results in heat dissipation of the DC power supply 3 difficult. Hence the lifespan of the DC power supply 3 suffers, and in the event that the DC power supply 3 is damaged, replacement is also difficult.

In addition, in the event that the DC power supply 3 is burnt out and on fire, as it is installed on a ceiling, instant alarm is not always possible, and the fire could also be spread to further result in even more serious danger. Furthermore, the DC power supply 3 usually is connected to the AC power source, users who try to replace the LEDs 2 could inadvertently suffer electric shock.

SUMMARY OF THE INVENTION

The primary object of the present invention is to provide an LED illumination system with a single DC power supply to provide electric power required by a plurality of LED illumination lamp sets to save cost and avert high temperature from affecting the lighting efficiency of the LED illumination lamp sets, and also avoid the hazard of electric shock during repair and maintenance of the LED illumination lamp sets.

To achieve the foregoing object, the LED illumination system according to the invention includes at least two LED illumination lamp sets, a DC power supply and at least two power circuits corresponding to the LED illumination lamp sets. The DC power supply provides sufficient electric power for the LED illumination lamp sets, and is connected to the LED illumination lamp sets via the power circuits to reduce the number of the power supply needed and save cost. The LED illumination lamp sets also are separated from the DC power supply so that the high temperature generated by the DC power supply does not affect the lighting efficiency of the LED illumination lamp sets, and the hazard of electric shock during repair and maintenance of the LED illumination lamp sets can also be avoided.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
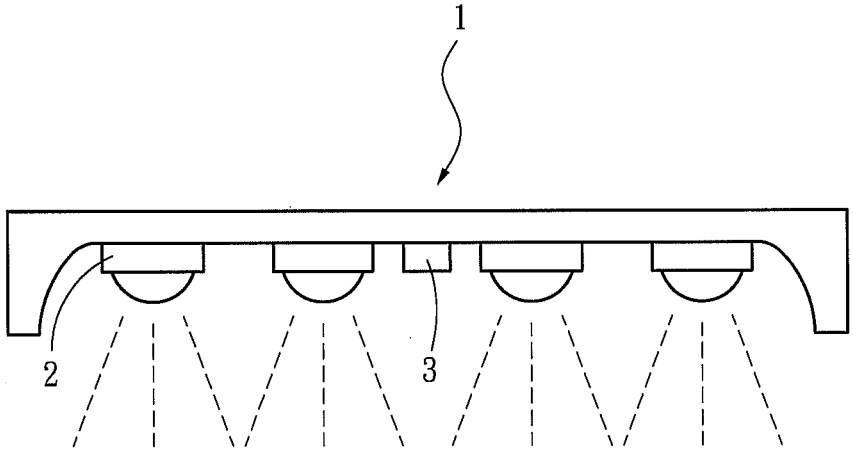
Fig . 1 PRIOR ART
FIG. 1 is a schematic view of a conventional LED illumination lamp set.
Figure 2:
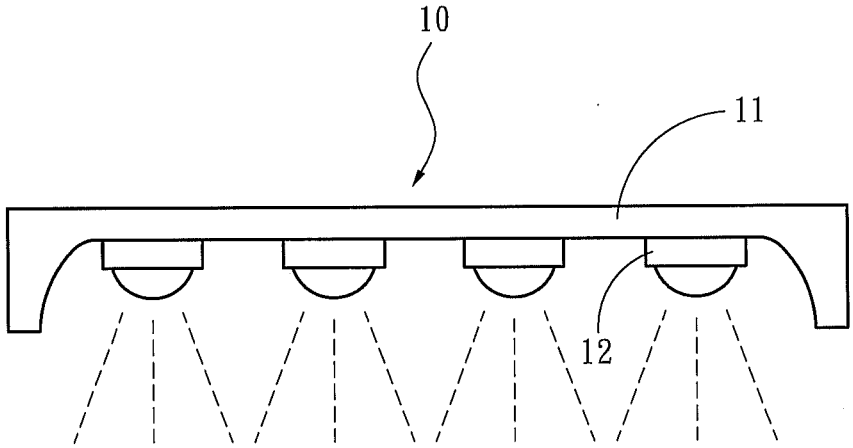
FIG. 2 is a schematic view of the LED illumination lamp set of the invention.
Figure 3:
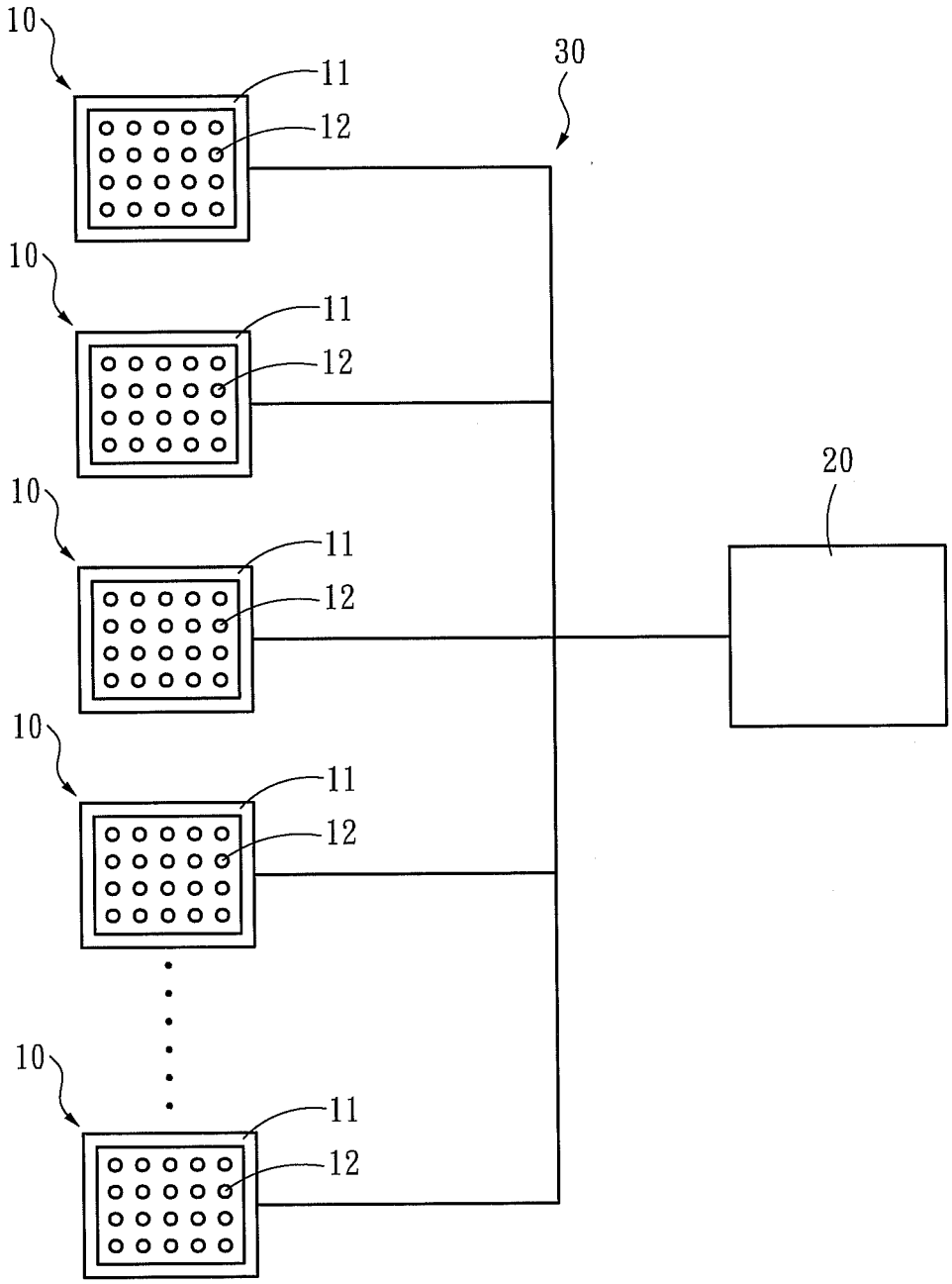
FIG. 3 is a schematic view of a configuration of the LED illumination system of the invention.
Figure 4:
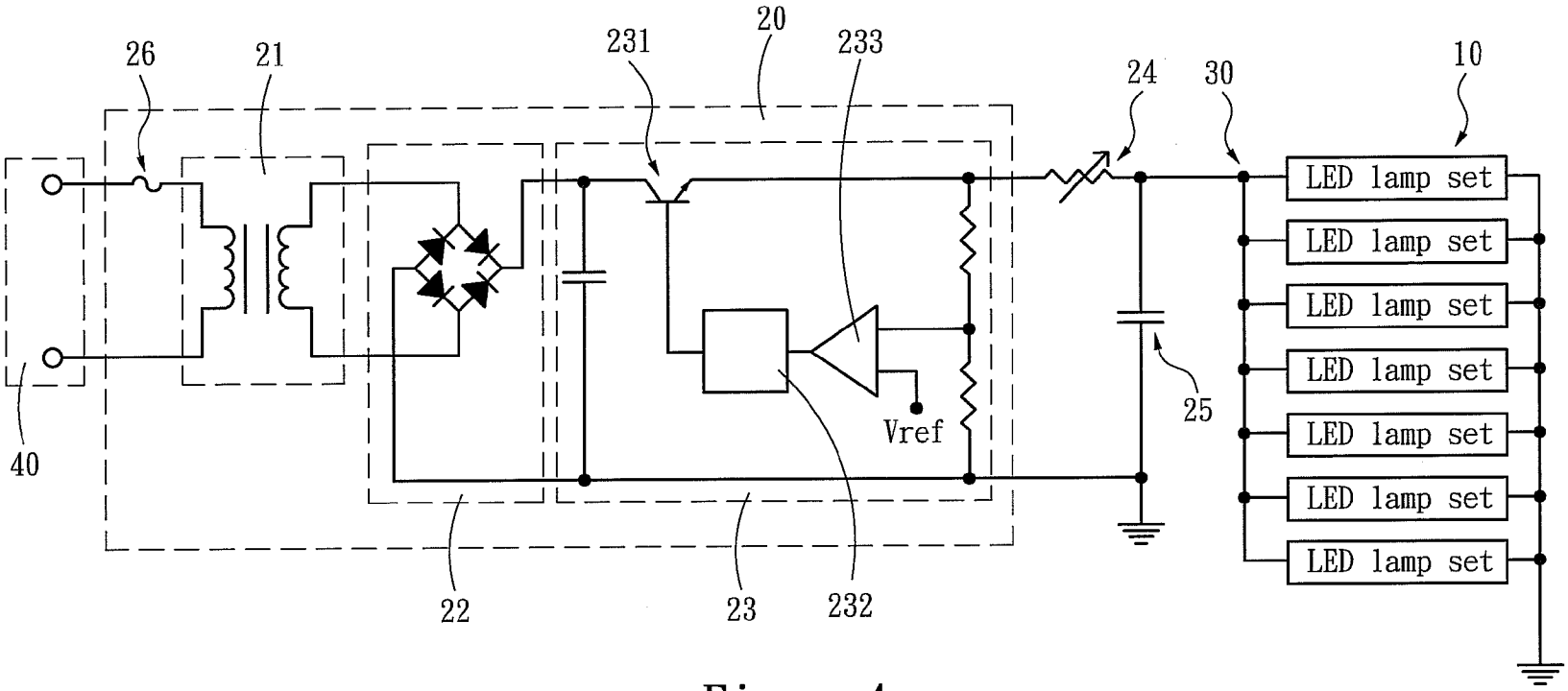
FIG. 4 is a schematic circuit diagram of the LED illumination system of the invention.

Please refer to FIGS. 2, 3 and 4, the present invention aims to provide an LED illumination system that includes at least two LED illumination lamp sets 10, a DC power supply 20 and at least two power circuits 30 corresponding to the LED illumination lamp sets 10.

Each LED illumination lamp set 10 includes a reflective lamp shell 11 and a plurality of LEDs 12 which can generate light after receiving voltage. The light generated by the LEDs 12 is then reflected by the reflective lamp shell 11 for illumination.

The DC power supply 20 provides sufficient electric power for the LED illumination lamp sets 10. However, the power supplied by the DC power supply 20 also can be adjusted according to the actual number of the LED illumination lamp sets 10.

The DC power supply 20 is connected to the LED illumination lamp sets 10 via the power circuits 30. The LED illumination lamp sets 10 can be arranged according to requirements to meet illumination need, and are supplied at a required voltage by the power circuits 30.

Also referring to FIG. 4, the DC power supply 20 includes a transformer 21, an AC/DC converter 22 and a pulse width modulator (PWM in short hereinafter) 23. The transformer 21 receives commercial power from an AC power source 40 and is connected to the AC/DC converter 22, which is then connected to the PWM 23, and the PWM 23 is further connected to the power circuits 30. The PWM 23 and the power circuits 30 can be bridged by an adjustable resistor 24 and coupled with a capacitor 25 in parallel respectively.

The PWM 23 mainly includes a Bipolar Junction Transistor (BJT) 231, a base driver 232 and an operational amplifier (OP) 233. The operational amplifier 233 sends a feedback incorporating with the base driver 232 and BJT 231 to generate pulse width modulation. The transformer 21 and the AC power source 40 may also be bridged by a fuse 26.

By means of the structure set forth above, only a single DC power supply 20 can supply electric power required by the LED illumination lamp sets 10, hence the number of the DC power supply 20 can be reduced. Compared with the conventional techniques, the invention provides many advantages, notably:

1. Save material cost and total cost is reduced.

2. The LED illumination lamp sets 10 and DC power supply 20 are separated, thus the high temperature generated by the DC power supply 20 does not affect the lighting efficiency of the LED illumination lamp sets 10.

3. The hazard of electric shock to users caused by inadvertently touching the AC power source 40 during repair and maintenance of the LED illumination lamp sets 10 can be avoided.

4. Through the PWM 23, adjustable resistor 24 and capacitor 25, stability of the LED illumination system improves, and output voltage thereof can be adjusted as desired to alter the luminosity of the LED illumination lamp sets 10 to satisfy user's preference.

What is claimed is:

1. An LED illumination system, comprising:

at least two LED illumination lamp sets;

a DC power supply providing adequate electric power for the LED illumination lamp sets; and at least two power circuits corresponding to the LED illumination lamp sets, the DC power supply being connected to the LED illumination lamp sets via the power circuits, wherein the DC power supply includes a transformer, an AC/DC converter and a pulse width modulator, the transformer receiving commercial power from an AC power source and being connected to the AC/DC converter, the AC/DC converter being connected to the pulse width modulator which is connected to the power circuits; and wherein the pulse width modulator and the power circuits are bridged by an adjustable resistor and coupled with a capacitor in parallel respectively.

2. The LED illumination system of claim 1, wherein each of the LED illumination lamp sets includes a reflective lamp shell and a plurality of light emitting diodes.

3. The LED illumination system of claim 1, wherein the transformer and the AC power source are bridged by a fuse.

* * * * *